United States Patent [19]

Yamamura et al.

[11] Patent Number: 4,937,008

[45] Date of Patent: Jun. 26, 1990

[54] CONCENTRATED SOFTENING AGENT FOR USE IN CLOTHINGS: QUATERNARY AMMONIUM SALT, MONO-OL, DI- OR TRI-OL, INORGANIC SALT AND POLYESTER

[75] Inventors: Masaaki Yamamura; Junichi Inokoshi; Tetuo Ito; Kazumitsu Furuta, all of Tochigi, Japan

[73] Assignee: Kao Corporation, Tokyo, Japan

[21] Appl. No.: 305,938

[22] Filed: Feb. 2, 1989

[30] Foreign Application Priority Data

Feb. 17, 1988 [JP] Japan ..... 63-34701

[51] Int. Cl.[5] ..... D06M 13/46; D06M 11/04; D06M 15/53

[52] U.S. Cl. ..... 252/8.8; 252/8.6; 252/8.9; 8/115.6

[58] Field of Search ..... 252/8.8, 8.9

[56] References Cited

U.S. PATENT DOCUMENTS

| | | | |
|---|---|---|---|
| 3,838,057 | 9/1974 | Barnes | 252/117 |
| 4,075,110 | 2/1978 | Duffin | 252/8.8 |
| 4,265,772 | 5/1981 | Jones | 252/8.6 |
| 4,272,386 | 6/1981 | Draper, Jr. et al. | 252/8.6 |
| 4,338,204 | 7/1982 | Spadini et al. | 252/8.75 |
| 4,476,030 | 10/1984 | May et al. | 252/8.8 |
| 4,767,547 | 8/1988 | Straathof et al. | 252/8.8 |
| 4,885,102 | 12/1989 | Yamamura et al. | 252/8.8 |

FOREIGN PATENT DOCUMENTS 299787 1/1989 European Pat. Off. .

*Primary Examiner*—A. Lionel Clingman

*Attorney, Agent, or Firm*—Flynn, Thiel, Boutell & Tanis

[57] ABSTRACT

A concentrated softening agent for use in clothings comprising, as the essential ingredient:

(a) from 10 to 20 by weight of one or more of quarternary ammonium salts, (b) from 0.5 to 3% by weight of an alkylene oxide addition 10–50M product containing, as an essential ingredient, ethylene oxide of an unsaturated or branched alcohol with 12 to 24 carbon atoms, or an unsaturated or branched alliphatic acid with 12 to 24 carbon atoms, (c) from 0.5 to 2.0% by weight of a monohydric alcohol with 1 to 3 carbon atoms, (d) from 3 to 15% by weight of a di- or tri-valent polyol with 2 to 3 carbon atoms, (e) from 0.05 to 0.4% by weight of an inorganic salt, and (f) from 0.3 to 5% by weight of one or more of polyether compound or derivative thereof which is prepared by adding an alkylene oxide containing, as the essential ingredient, ethylene oxide to a compound having three or more active hydrogen atoms, in which the total weight for the polyoxyethylene chain moiety is more than 60% by weight of the entire weight and having a molecular weight is from 5,000 to 2,000,000.

12 Claims, No Drawings

CONCENTRATED SOFTENING AGENT FOR USE IN CLOTHINGS: QUATERNARY AMMONIUM SALT, MONO-OL, DI- OR TRI-OL, INORGANIC SALT AND POLYESTER

BACKGROUND OF THE INVENTION

1. Field of the Invention

The present invention concerns a softening agent and more particularly, it relates to a concentrated softening agent for use in clothing, which agent exhibits less viscosity increase with age and is capable of providing various kinds of fabrics with excellent softness and antistatic property.

2. Description of the Prior Art

During wearing and repeated washing of clothings, fabric processing chemicals are washed out or the clothings per se are hardened due to deterioration whereby to result in an undesired feel. In view of the above, softening agents capable of providing fabrics with softness and antistatic property have generally often been used in homes.

At present, most of the commercially available, home use, softening agents comprise, as the main ingredient, cationic surface active agents having 1–2long chain alkyl groups in one molecule, for example, di(hardened tallow alkyl)dimethylammonium salts.

These softening base materials comprising such quaternary ammonium salts as the main ingredient are less water soluble and are usually produced in the form of 3 to 5 wt% aqueous dispersion or emulsion. Along with the increase of clothing for which the softening agents are used, there has keenly been demanded a concentrated softening agent for use in clothing which agent is a highly concentrated aqueous dispersion, for reducing the distribution cost and packaging cost, and reducing the amount of storage space required in homes and shops.

However, if the concentration of the softening base material exceeds 5% by weight, the viscosity of the aqueous dispersion is remarkably increased so as to cause various handling troubles.

For producing softening agents at such a high concentration, there have been known, for example, (1) a method of adding a water soluble cationic surface active agent, (2) a method of adding an ethylene oxide adduct of a higher alcohol or alkyl phenol, (3) a method of adding urea or ethylene glycol and (4) a method of adding a water soluble salt.

However, the methods (1)–(3) can provide no satisfactory effect since the concentration is insufficient or the viscosity increases with time.

In the case of the method (4), although an effect of lowering the initial viscosity can be obtained, there is no satisfactory effect of suppressing the increase of the viscosity with aging. In addition, if the salt is added in a great amount, the aqueous dispersion tends to be separated and, accordingly, satisfactory concentrated softening agents for use in clothing have not yet been obtained.

SUMMARY OF THE INVENTION

In view of the foregoing situation, the present inventors have made an earnest study for overcoming the foregoing problems and have made the finding that the initial physical property can be improved and the increase of the viscosity with aging can remarkably be suppressed by a specific blended composition in which a softening base material is dispersed at a high concentration and have accomplished the present invention concerning a concentrated softening agent for use in clothing based on the above-mentioned finding.

The foregoing object of the present invention can be attained by a concentrated softening agent for use in clothing, which agent has excellent storage stability, comprising, as the essential ingredients:

(a) from 10 to 20% by weight of one or more of quaternary ammonium salts, (b) from 0.5 to 3% by weight of an addition product of (i) from 10–50 mols of alkylene oxide containing, as an essential ingredient, ethylene oxide, with (ii) one mol of an unsaturated or branched alcohol having 12 to 24 carbon atoms or an unsaturated or branched aliphatic acid having 12 to 24 carbon atoms, (c) from 0.5 to 2.0% by weight of a monohydric alcohol having 1 to 3 carbon atoms, (d) from 3 to 15% by weight of a di- or tri-valent polyol having 2 to 3 carbon atoms, (e) from 0.05 to 0.4% by weight of an inorganic salt, and (f) from 0.3 to 5% by weight of one or more of polyether compound or derivative thereof which is prepared by adding an alkylene oxide containing ethylene oxide as the essential ingredient to a compound having three or more active hydrogen atoms, in which the total weight for the polyoxyethylene chain moiety is more than 60% of the entire weight and the molecular weight is from 5,000 to 2,000,000.

The quaternary ammonium salt (a) used as the softening base material for use in clothing in the present invention can include, for example, the following, which may be used as a mixture of two or more of them.

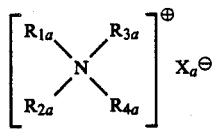

(I$_a$)

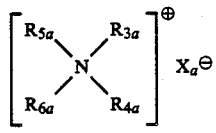

(II$_a$)

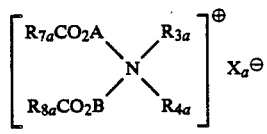

(III$_a$)

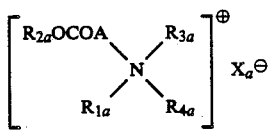

(IV$_a$)

-continued

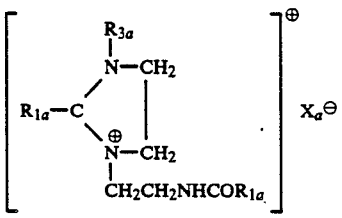

(V$_a$)

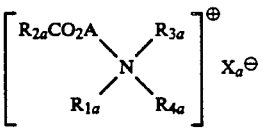

(VI$_a$)

$R_{1a}$: saturated or unsaturated linear or branched $C_8$–$C_{22}$ aliphatic hydrocarbon group or hydroxy-substituted aliphatic hydrocarbon group, $R_{2a}$: saturated or unsaturated, linear or branched $C_8$–$C_{24}$ aliphatic hydrocarbon group or hydroxy-substituted aliphatic hydrocarbon group, $R_{3a}$, $R_{4a}$, $R_{6a}$: $C_1$–$C_3$ alkyl group, hydroxy-substituted alkyl group or $$-(CH_2-\underset{\underset{Ya}{|}}{CH}-O)_n-H$$

in which n=1–10, Ya=hydrogen or $CH_3$, $R_{5a}$: saturated or unsaturated branched $C_{24}$–$C_{36}$ aliphatic hydrocarbon group or substituted aliphatic hydrocarbon group;

$R_{7a}$, $R_{8a}$: saturated or unsaturated linear or branched $C_7$–$C_{21}$ aliphatic hydrocarbon group or substituted aliphatic hydrocarbon group;

A, B: $C_1$–$C_3$ alkylene group;

Xa: $CH_3SO_4$, $C_2H_5SO_4$, $C_nH_{2n+1}COO$, in which n=0–17, $C_nH_{2n+1}OPO_3$ in which n=8–18, $HOCH_2COO$,

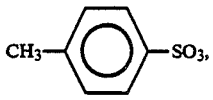

halogen.

The ingredient (b) in the present invention can be synthesized by adding an alkylene oxide by a usual method to a branched aliphatic acid with 12 to 24 carbon atoms such as 4,4-dimethyl decanoic acid, 2-butyltetradecanoic acid and 2-methylheptadecanoic acid, a branched alcohol with 12 to 24 carbon atoms derived from 4–8 unit oligomer of propylene, an unsaturated aliphatic acid with 12 to 24 carbon atoms such as 5-dodecenic acid, oleic acid and erucic acid, an unsaturated alcohol with 12 to 24 carbon atoms such as oleyl alcohol and erucic alcohol. It is, however, necessary that the alkylene oxide essentially contains ethylene oxide. The alkylene oxide added is preferably ethylene oxide or a mixture of ethylene oxide and propylene oxide and a preferred addition mol number is from 10 to 50 mols and, particularly, from 20 to 40 mols. Among the alkylene oxide added, it is preferred that more than 80% by weight thereof is ethylene oxide.

Although the reason is not clear why the unsaturated group or branched hydrophobic group is necessary as the ingredient (b) in the present invention, it is considered that such a hydrophobic group hinders the crystallization at the surface of the ingredient (a) when adsorbed to the ingredient (a) dispersed in water, to thereby improve the storage stability. The effect of adding the ingredient (b) is insufficient if it is less than 0.5% by weight, whereas the viscosity is increased if it is in excess of 3% by weight.

As the ingredient (c) in the present invention, there can be mentioned methanol, ethanol, isopropanol, etc., which is used as a reaction solvent for preparing the ingredient (a). The ingredient (c) can provide satisfactory storage stability and initial physical property if used at a ratio from 0.5 to 2.0% by weight. However, it shows only poor stability at high temperature if it is less than 0.5% by weight and, on the other hand, results in undesired effect such as increased viscosity at room temperature if it exceeds 2.0% by weight.

As the ingredient (d), there can be mentioned ethylene glycol, propylene glycol, diethylene glycol, glycerine, etc., which is particularly effective for the store-stability at low temperature in combination with other ingredients (a)–(f). The blending amount is preferably from 3 to 15% by weight and, particularly, from 5 to 10% by weight.

As the ingredient (e) in the present invention, there can be mentioned NaCl, $CaCl_2$, $MgCl_2$, etc. In the present invention, a portion of the ingredient (e) is by-produced and incorporated upon preparation of the ingredient (a) and it is used preferably in an amount from 0.05 to 0.4% by weight in total.

As the compound containing three or more active hydrogen atoms as the starting material for the polyoxyalkylene addition product used as the ingredient (f) in the present invention, there can be mentioned polyhydric alcohols such as trimethylol propane, triethanolamine, glycerine, pentaerythritol, sorbitol, sucrose, polyglycerine, polyvinyl alcohol and partial saponification product of polyvinyl acetate; polyhydric phenols such as phenol resin or alkylphenol formaldehyde condensates; and polyamine compounds such as ethylenediamine, diethylenetriamine, triethylenetetramine, tetraethylenepentamine, pentaethylenehexamine or polyethyleneimine. Further, partially amidation products or N-alkyl substituted triamines as derivatives of such polyamines can also be used if they contain three or more not-substituted active hydrogen atoms. Further, alkane amines containing both of NH group or OH group such as monoethanol amine and diethanol amine can also be used.

The polyether compound as the polyoxyalkylene product can be prepared easily by adding an alkylene oxide containing ethylene oxide as the essential ingredient by a usual method to a compound containing three or more active hydrogen atoms. Among them, addition product of ethylene oxide alone or a blocked or partially blocked addition product of ethylene oxide and propylene oxide is preferred, in which the they may be added in an optional sequence, but a preferred concentrated softening agent for use in clothing can be obtained by previously adding propylene oxide (hereinafter simply referred to as PO) and, thereafter, adding ethylene oxide (hereinafter simply referred to as EO).

The molecular weight of the polyether compound or the derivative thereof is from 5,000 to 2,000,000 and, preferably, from 10,000 to 100,000. Further, the total weight for the EO chain moiety is more than 60% by weight and, preferably, more than 80% by weight of the entire molecular weight.

As the derivative of the polyether compound of the present invention, there can be mentioned those cross-linking products with a compound having isocyanate group, etc., those prepared by sulfating, phosphatizing, carboxyalkylating or aliphatic acid the terminal hydroxyl group of a polyether compound, or those derivatives in which the nitrogen atoms are cationically modified partially. Among them, aliphatic esterifying products and cationically modified products are particularly preferred.

In the case of aliphatic acid esterification, an aliphatic acid with 7 to 23 carbon atoms is preferably used, but the number of double bonds or branchings therein gives no substantial effect on the performance.

As the cationically modified products, there can be mentioned those compounds obtained by cationically modifying a polyether compound with a dialkyl sulfate or halogenated alkyl, or cationically modified products neutralized with acetic acid, alkylbenzene sulfonic acid, etc.

The amount of the ingredient (f) used in the present invention is from 0.3 to 5% by weight, particularly, from 0.5 to 3.0% by weight and the storage stability can be improved remarkably within such a range.

Generally, the concentrated softening agent for use in clothing according to the present invention is used by being blended with perfumes, dyes, silicone compounds, bacteriocidal agent, etc. which are conventionally employed in softening agents for use in clothing.

Those derivatives, such as mono- or di-aliphatic acid esters of glycerine, esters such as oils and fats, partial amidation products of polyalkylene polyamines, for example, diethylene triamine aliphatic acid, such as stearic acid, may be used in combination as other softening base materials.

There is no particular restriction on the procedures for blending ingredients (a)–(f) and other ingredients. The desired products of satisfactory initial physical property can be obtained efficiently by adding the ingredient (a) in an aqueous solution to a portion of the ingredient (e) under an elevated temperature and then subsequently adding the remaining portion of the ingredient (e) or other ingredients.

As the mixer, there can be used a blade agitator, a line mixer or a high pressure jetting mixer, and the dispersing performance is improved by previously mixing using a kneader or blade stirrer and, thereafter, using a stirrer a large shearing force.

The concentrated softening agent for use in clothing according to the present invention containing (a)–(f) as the essential ingredients can provide the effect by the amount of use substantially in an inverse proportion with the effective ingredients as compared with softening agents at usual concentration. Accordingly, it can provide excellent effect of providing remarkable energy saving and resource saving in each of the stages of transportation, packaging and storing.

EXAMPLES

The present invention is to be described specifically by way of examples but the invention is not limited only to them.

EXAMPLES 1-8, COMPARATIVE EXAMPLES 1-3

Table 1 shows the ingredient (a), Table 2 shows the ingredients (b) and Table 3 shows the ingredient (f). Table 4 shows the storage stability of the concentrated softening agent using these ingredients.

(1) Values for the physical property, and the stability

The concentrated softening agent for use in clothings was stored at −10° C., room temperature and 50° C., respectively for 20 days and the appearance and the flowing property were measured.

Any of the concentrated softening agents for use in clothing according to the present invention was satisfactory with no substantial aging change.

(2) Softening performance

Commercially available cotton towels, knitted underwears, acrylic fabrics, polyester fabrics and mixed spun fabrics were washed repeatedly for five times using a commercially available detergent "ZABU" (registered trade name of products manufactured by Kao Corp.). Then, after removing the detergent attached to fabrics, they were treated by using an aqueous 0.1% by weight solution (converted as the effective ingredient; with 3.5° DH hard water) of the concentrated softening agent for use in clothings according to the present invention at 25° C., with bath ratio 1/30 for 1 min under stirring. Then, after air-drying in a room, they were left in a thermostable and humidity stable chamber at 25° C., 65% RH for 24 hours. When comparing the softening performance with clothing treated by the same manner with the softening agent at usual concentration, the tested products had sufficient softening performance.

TABLE 1

| Ingredient (a) | | |
|---|---|---|
| (a-1) | Compound (Ia) | $R_{1a} = R_{2a}$ = Hardened tallow composition alkyl ($C_{16} \sim C_{18}$)<br>$R_{3a} = R_{4a}$ = Methyl<br>$X_a$ = Cl |
| (a-2) | Compound (Ia) | $R_{1a}$ = $C_{22}$ alkyl, $R_{2a}$ = $C_{12}$ alkyl<br>$R_{3a} = R_{4a}$ = Methyl<br>$X_a$ = Cl |
| (a-3) | Compound (Va) | $R_{1a}$ = $C_{17}$ Alkenyl<br>$R_{3a}$ = Methyl<br>$X_a = CH_3SO_4$ |

TABLE 2

| Ingredient (b) | |
|---|---|
| (b-1) | EO (25 mol) addition product of oleyl alcohol |
| (b-2) | EO (35 mol) addition product of isostearic acid |

TABLE 3

| Ingredient (f) | | |
|---|---|---|
| (f-1) | EO addition product of glycerine | (MW 8,900) |
| (f-2) | Addition product of glycerine with PO/EO = 15/85 | (MW 10,000) |
| (f-3) | Addition product of sorbitol with PO/EO = 10/90 | (MW 15,000) |
| (f-4) | Addition product of tetraethylene pentamine with PO/EO = 2/98 | (MW 20,000) |
| (f-5) | Addition product of polyethyleneimine with PO/EO = 5/95 | (MW 300,000) |

TABLE 4

| Stability of concentrated softening agent for use in clothings | |
|---|---|
| Composition | |

TABLE 4-continued

Stability of concentrated softening agent for use in clothings

| | Amount of ingredient (a) (wt %) | Amount of ingredient (b) (wt %) | Amount of ingredient (c) (wt %) | Amount of ingredient (d) (wt %) | Amount of ingredient (e) (wt %) | Amount of ingredient (f) (wt %) | Amount of other ingredient (wt %) |
|---|---|---|---|---|---|---|---|
| Comparative Example | | | | | | | |
| 1 | a-1 | — | Isopropyl alcohol | Ethylene glycol | $CaCl_2$ | f-1 | Perfume |
| | 15 | | 2.2 | 7 | 0.2 | 2 | 0.4 |
| 2 | a-1 | — | Ethanol | Ethylene glycol | $CaCl_2$ | — | Perfume |
| | 15 | | 1.8 | 7 | 0.2 | | 0.4 |
| 3 | a-3 | b-1 | Isopropyl alcohol | Ethylene glycol | $CaCl_2$ | — | — |
| | 15 | 1 | 1.8 | 7 | 0.15 | | |
| Example | | | | | | | |
| 1 | a-1 | b-1 | Isopropyl alcohol | Ethylene glycol | $CaCl_2$ | f-1 | Perfume |
| | 15 | 1 | 1.8 | 7 | 0.2 | 2 | 0.4 |
| 2 | a-1 | b-2 | Ethanol | Propylene glycol | $CaCl_2$ | f-2 | Perfume |
| | 15 | 1.5 | 1.6 | 7 | 0.2 | 2 | 0.4 |
| 3 | a-2 | b-1 | Ethanol | Ethylene glycol | NaCl | f-1 | — |
| | 15 | 2 | 1.8 | 8 | 0.15 | 2 | |
| 4 | a-3 | b-2 | Ethanol | Ethylene glycol | $CaCl_2$ | f-4 | Perfume |
| | 15 | 2 | 1.4 | 8 | 0.2 | 2 | 0.4 |
| 5 | a-1 | b-2 | Ethanol | Ethylene glycol | $CaCl_2$ | f-3 | Perfume |
| | 15 | 2 | 1.6 | 8 | 0.2 | 2 | 0.4 |
| 6 | a-1 | b-2 | Isopropyl alcohol | Ethylene glycol | $CaCl_2$ | f-5 | — |
| | 15 | 2 | 1.8 | 8 | 0.2 | 2 | |
| 7 | a-1 | b-1 | Isopropyl alcohol | Ethylene glycol | $CaCl_2$ | f-4 | — |
| | 15 | 2 | 1.4 | 7 | 0.2 | 2 | |
| 8 | a-2 | b-1 | Ethanol | Ethylene glycol | $CaCl_2$ | f-3 | Perfume |
| | 15 | 2 | 1.8 | 8 | 0.2 | 2 | 0.4 |

| | Stability at the initial stage and 30 days after | | | | |
|---|---|---|---|---|---|
| | Initial physical property | | Stability 30 days after (viscosity)*1 | | |
| | Viscosity | Appearance | −10° C. | Room temperature | 50° C |
| Comparative Example | | | | | |
| 1 | 200 | good | >1,000 | 490 | 970 |
| 2 | 160 | good | >1,000 | 380 | >1,000 |
| 3 | 340 | good | >1,000 | 700 | >1,000 |
| Example | | | | | |
| 1 | 120 | good | 380 | 150 | 340 |
| 2 | 130 | good | 320 | 160 | 330 |
| 3 | 130 | good | 280 | 140 | 300 |
| 4 | 120 | good | 180 | 120 | 190 |
| 5 | 140 | good | 170 | 160 | 190 |
| 6 | 130 | good | 150 | 140 | 150 |
| 7 | 130 | good | 160 | 140 | 150 |
| 8 | 130 | good | 170 | 140 | 140 |

What is claimed is:

1. A concentrated, cloth-softening, liquid composition, comprising (a) from 10 to 20 wt.% of one or a mixture of two or more long chain quaternary ammonium salts effective as cloth-softening agents, (b) from 0.5 to 3 wt.% of a substance obtained by adducting (i) from 10 to 50 moles of alkylene oxide selected from the group consisting of ethylene oxide alone or a combination of more than 80 wt.% of ethylene oxide and the balance is propylene oxide to (ii) one mole of a material selected from the group consisting of branched aliphatic acids having 12 to 24 carbon atoms, branched aliphatic alcohols having 12 to 24 carbon atoms, unsaturated fatty acids having 12 to 24 carbon atoms and unsaturated aliphatic alcohols having 12 to 24 carbon atoms, (c) from 0.5 to 2.0 wt.% of a monohydric aliphatic alcohol having from 1 to 3 carbon atoms, (d) from 3 to 15 wt.% of a dihydric or trihydric, aliphatic polyol having 2 to 4 carbon atoms, (e) from 0.05 to 0.4 wt.% of an inorganic, water-soluble salt, and (f) from 0.3 to 5 wt.% of one or more substances selected from the group consisting of (i) polyethers prepared by adducting ethylene oxide alone or both of ethylene oxide and propylene oxide to a compound having at least 3 active hydrogen atoms and which is selected from the group consisting of polyhydric alcohols, polyhydric phenols, polyamines, N-alkyl substituted triamines and hydroxyalkyl amines, said polyether having a molecular weight of from 5,000 to 2,000,000 and containing more than 60 wt.% of ethylene oxide, based on the total weight of the polyether, (ii) sulfates, phosphates, carboxyalkylates and aliphatic fatty acid esters of the terminal hydroxyl group of said polyethers, and the balance comprises water.

2. A concentrated softening agent as defined in claim 1, wherein the quaternary ammonium salt is selected from the group consisting of:

(I$_a$)

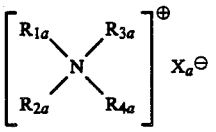

(II$_a$)

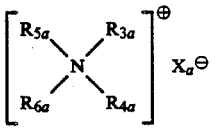

(III$_a$)

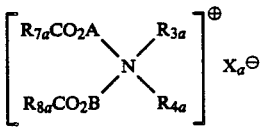

(IV$_a$)

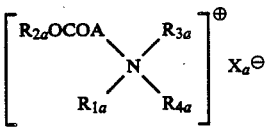

(V$_a$)

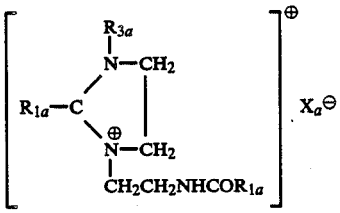

(VI$_a$)

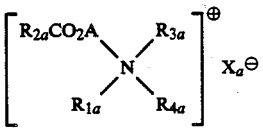

$R_{1a}$ is a $C_8$ to $C_{22}$, saturated or unsaturated, linear or branched, aliphatic hydrocarbon group or hydroxy-substituted aliphatic hydrocarbon group, $R_{2a}$ is a $C_8$ to $C_{24}$, saturated or unsaturated, linear or branched, aliphatic hydrocarbon group or hydroxy-substituted aliphatic hydrocarbon group, $R_{3a}$, $R_{4a}$, $R_{6a}$ each is a $C_1$–$C_3$ alkyl or hydroxyalkyl group or a group of the formula $$-(CH_2-\underset{\underset{Ya}{|}}{CH}-O)_n-H$$

in which n is an integer of from 1–10, and Ya=hydrogen or $CH_3$, $R_{5a}$ is a $C_{24}$ to $C_{36}$, saturated or unsaturated, branched, aliphatic hydrocarbon group or hydroxy-substituted aliphatic hydrocarbon group;

$R_{7a}$, $R_{8a}$ each is a $C_7$ to $C_{21}$, saturated or unsaturated, linear or branched, aliphatic hydrocarbon group or hydroxy-substituted aliphtic hydrocarbon group;

A, B each is a $C_1$ to $C_3$ alkylene group; and

Xa is a $CH_3SO_4$, $C_2H_5SO_4$, $C_nH_{2n+1}COO$, in which n is an integer of 0 to 17, $C_{n'}H_{2n'+1}OPO_3$ in which n' is an integer of 8 to 18, $HOCH_2COO$,

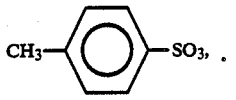

or halogen.

3. A composition as claimed in claim 1 in which said material (b) (ii) is selected from the group consisting of 4,4-dimethyl decanoic acid, 2-butyltetradecanoic acid, 2-methylheptadecanoic acid, a branched alcohol having 12 to 24 carbon atoms and derived from a propylene oligomer having 4 to 8 propylene units, 5-dodecenic acid, oleic acid, erucic acid, oleyl alcohol and erucic alcohol.

4. A composition as claimed in claim 1 in which said substance (b) is obtained by adducting 20 to 40 moles of said alkylene oxide to one mole of said material (b) (ii).

5. A composition as claimed in claim 1 in which ingredient (c) is selected from the group consisting of methanol, ethanol and isopropanol.

6. A composition as claimed in claim 1 in which the amount of ingredient (d) is from 5 to 10 wt.% and ingredient (d) is selected from the group consisting of ethylene glycol, propylene glycol, diethylene glycol and glycerol.

7. A composition as claimed in claim 1 in which ingredient (e) is selected from the group consisting of NaCl, $CaCl_2$ and $MgCl_2$.

8. A composition as claimed in claim 1 in which said polyhydric alcohol is selected from the group consisting of trimethylol propane, triethanolamine, glycerol, pentaerythritol, sorbitol, sucrose, polyglycerine, polyvinyl alcohol and partial saponification product of polyvinyl acetate, said polyhydric phenol is selected from the group consisting of phenol resin and alkylphenol-formaldehyde condensates, and said polyamine is selected from the group consisting of ethylenediamine, diethylenetriamine, triethylenetetramine, tetraethylenepentamine, pentaethylenehexamine and polyethyleneimine, and said hydroxyalkylamine is selected from the group consisting of monoethanolamine and diethanolamine.

9. A composition as claimed in claim 1 in which said polyether has a molecular weight of from 10,000 to 100,000 and contains more than 80 wt.% of ethylene oxide.

10. A composition as claimed in claim 1 in which ingredient (f) is an ester of said polyether prepared by reacting said polyether with an aliphatic carboxylic acid having from 7 to 23 carbon atoms.

11. A composition as claimed in claim 1 in which the amount of ingredient (f) is from 0.5 to 3.0 wt.%.

12. A composition as claimed in claim 1 in which ingredient (a) is selected from the group consisting of

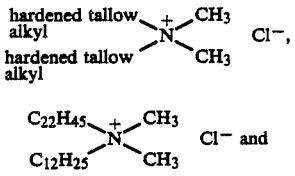

-continued

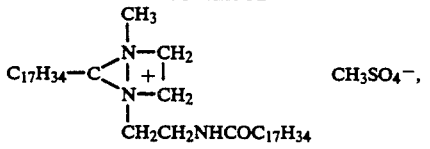

ingredient (b) is selected from the group consisting of the adduct of 25 mols of ethylene oxide to one mol of oleyl alcohol and the adduct of 35 mols of ethylene oxide to one mol of isostearic acid, ingredient (f) is selected from the group consisting of the adduct of ethylene oxide to glycerol and having a molecular weight of 8,900, the adduct of propylene oxide/ethylene oxide to glycerol and having a molecular weight of 10,000 and a weight ratio of propylene oxide/ethylene oxide of 15/85, the adduct of propylene oxide/ethylene oxide to sorbitol and having a molecular weight of 15,000 and a weight ratio of propylene oxide/ethylene oxide of 10/90, the adduct of propylene oxide/ethylene oxide to tetraethylene pentamine and having a molecular weight of 20,000 and a weight ratio of propylene oxide/ethylene oxide of 2/98, and the adduct of propylene oxide/ethylene oxide to polyethyleneimine and having a molecular weight of 300,000 and a weight ratio of propylene oxide/ethylene oxide of 5/95, ingredient (c) is selected from the group consisting of ethanol and isopropanol, ingredient (d) is selected from the group consisting of ethylene glycol and propylene glycol, and ingredient (e) is selected from the group consisting of $CaCl_2$ and NaCl.

* * * * *